United States Patent [19]

Sekino

[11] Patent Number: 4,841,607

[45] Date of Patent: Jun. 27, 1989

[54] PROCESS FOR PRODUCING CLOTH FOR STUFFED ANIMAL TOYS

[76] Inventor: Yonesaku Sekino, 4-27-3 Shinkoiwa, Katsushika,-Ku, Tokyo, Japan

[21] Appl. No.: 912,238

[22] Filed: Sep. 29, 1986

[51] Int. Cl.[4] ..... D04D 7/00; D04B 39/00

[52] U.S. Cl. ..... 28/160; 66/169 R

[58] Field of Search ..... 28/160; 66/169 R, 170, 66/194; 289/1.5; 112/410, 411, 416, 429, 430, 439; 446/319, 369

[56] References Cited

U.S. PATENT DOCUMENTS

| | | | |
|---|---|---|---|
| 1,939,136 | 12/1933 | Romane | 28/160 X |
| 2,881,504 | 4/1959 | Billion | 28/278 |
| 3,050,819 | 8/1962 | Allman, Jr. et al. | 28/278 |
| 3,174,451 | 3/1965 | Heiks | 112/410 |
| 4,182,527 | 1/1980 | Meehan | 289/1.5 |
| 4,413,847 | 11/1983 | Doyel | 289/17 |

FOREIGN PATENT DOCUMENTS

| | | | |
|---|---|---|---|
| 2458617 | 2/1981 | France | 66/170 |
| 4630470 | 9/1971 | Japan | 28/160 |
| 4630471 | 9/1971 | Japan | 28/160 |
| 59-1766 | 1/1984 | Japan | 28/160 |
| 469966 | 8/1937 | United Kingdom | 112/410 |
| 1180342 | 2/1970 | United Kingdom | 112/410 |

*Primary Examiner*—Robert R. Mackey

*Attorney, Agent, or Firm*—Arthur T. Fattibene

[57] ABSTRACT

There is disclosed a process for producing a cloth for stuffed animal toys, comprising directly binding long or superlong fibers with the lining cloth of a high pile base cloth by hand knitting. The cloth produced by this process can dispense with back processing for preventing the fibers from falling off. The stuffed animal toy made of this cloth is endowed with a soft touch quite analogous to the natural one of the animal.

2 Claims, 2 Drawing Sheets

PROCESS FOR PRODUCING CLOTH FOR STUFFED ANIMAL TOYS

FIELD OF THE INVENTION

The present invention relates to a process for producing a cloth for stuffed animal toys, and particularly to a process for producing a cloth for stuffed animal toys imitating long-hair animals such as a maltese.

DESCRIPTION OF THE PRIOR ART

Known conventional cloth for animal toys of the kind as mentioned above includes one disclosed in Japanese Utility Model Publication No. 22,156/1984. This cloth has been produced by bonding a synthetic resin sheet to the back side of a boa cloth, or by coating a boa cloth with the same material as that of long fibers as mentioned below, flocking the long fibers after drying the coating, and bonding or welding a synthetic resin sheet as mentioned above to the portions of the long fibers protruding from the back side of the boa cloth with a coated adhesive or by heating the above-mentioned coating portion, correspondingly, to effect fixation of flocked long fibers for preventing the long fibers from falling off. The flocked cloth thus produced has been used in manufacturing various stuffed toys.

Since in the above-mentioned conventional way a synthetic resin sheet is bounded to the back side of a boa cloth with an adhesive applied to the synthetic resin sheet serving for bonding the flocked portions of long fibers thereto, or the back side of a boa cloth is coated with the same material as that of long fibers, followed by heat-welding the long fibers with the coating portion, the synthetic resin sheet bonded to the back of a boa cloth or the coating portion made of the same material as that of the long fibers is inevitably hardened. Therefore, when a stuffed toy made of this cloth is held by hands, the touch analogous to the natural one of an animal cannot be obtained because the above-mentioned hardened synthetic resin or coating portion is lacking in softness. Thus, there arises a problem to be solved for obtaining a cloth for stuffed animal toys which can give such a soft touch close to the natural one that it will give a feeling as if a real animal were embraced.

SUMMARY OF THE INVENTION

The present invention has been proposed with a view to solving the above-mentioned problem.

In accordance with the present invention, there is provided a process for producing a cloth for stuffed animal toys, comprising directly binding long or super-long fibers with the lining cloth of a high pile base cloth by hand knitting to thereby dispense with back processing for preventing the fibers from falling off.

In the present invention, a high pile base cloth having piles of, for example, 10 to 30 mm is used as the back lining. Fibers are bound in the bundled form of units each consisting of 10 to 15 fibers, which are folded substantially in the middle thereof, and are knitted in the above-mentioned base cloth. Therefore, the knitting interval can be generally 5 mm or more. Knitting and binding may be done at an interval of about 10 mm. Since one bundle consists of 10 to 15 fibers and is folded into two parts, there appears a state where 20 to 30 fibers are knitted and bound in one location. Thus, fibers having a length adapted to an animal, such as super-long or long fibers, can be knitted. In other words, although the knitting interval is long to some extent, an entirely and substantially bristling state appears because the knitted and bound fibers are overlapped and the piles themselves of the base cloth are long fibers. Further, since the common mode of hand knitting is employed without employing, for example, a means for heat-welding the knitted long fibers with the synthetic resin sheet or the coating agent for fixing the knitted fibers, there appear no hardened portions as in the case of conventional ones, which degrade the touch, but a soft bristling state analogous to those of real animals is materialized.

BRIEF DESCRIPTION OF THE DRAWINGS

An embodiment of the present invention will be illustrated with reference to the accompanying drawings, in which.

DESCRIPTION OF THE PREFERRED EMBODIMENT

Figure 1:
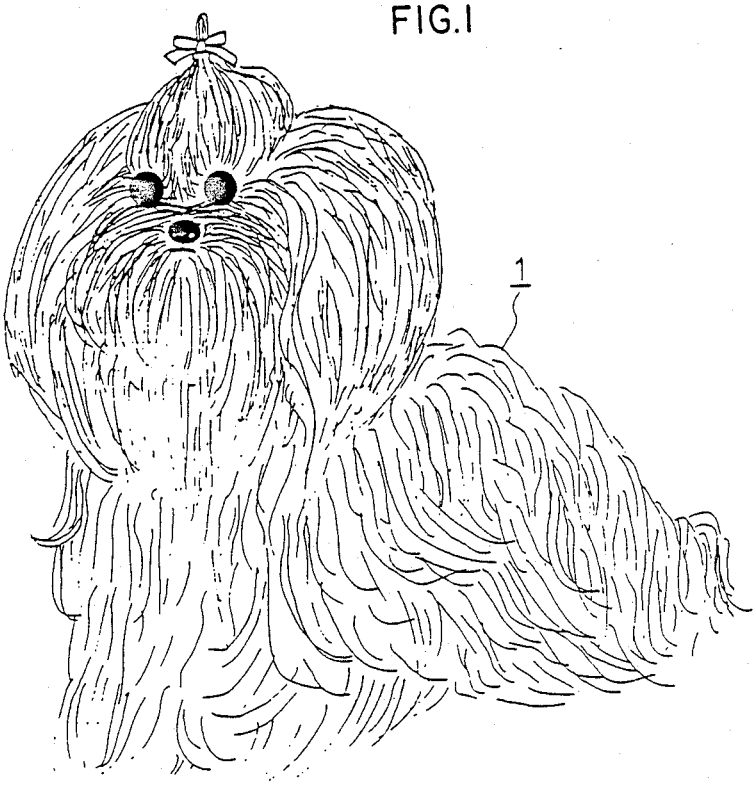
FIG. 1 is a perspective view of an animal toy made of a cloth produced according to the present invention.
Figure 2:
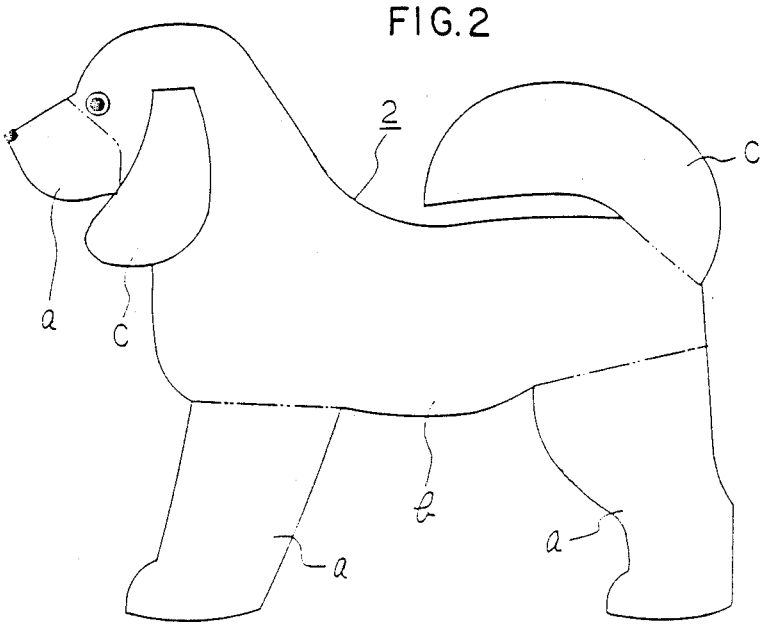
FIG. 2 is a side view of the side portion of an animal toy cut in making the same.
Figure 3:
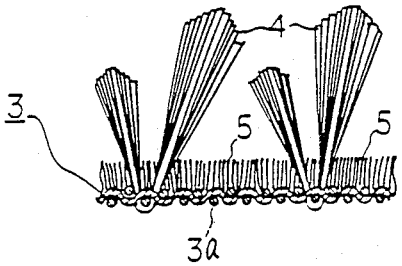
FIG. 3 is a diagram illustrating fibers knitted in a base cloth.
Figure 4:
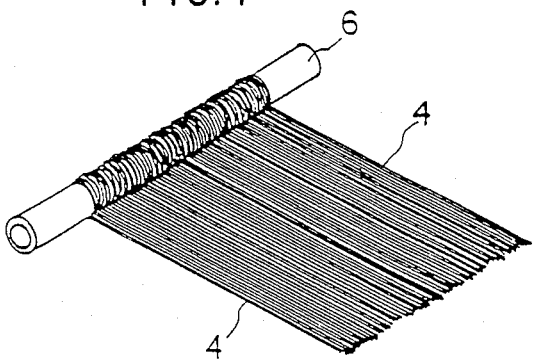
FIG. 4 is a diagram illustrating a manner of curling fibers.

An embodiment of the present invention will be described in detail with reference to the accompanying drawings. FIG. 1 shows an animal toy made of a cloth produced by the process of the present invention. FIG. 2 shows the side portion (2) of an animal toy (1) cut in making the animal toy using a cloth produced by the process of the present invention. This side portion (2) is put together with its counterpart on the other side and an abdominal portion, and sewn together in the joint portions with a urethane foam or a polyester staple packed inside for providing bulkiness and softness. FIG. 3 is a diagram illustrating a state of long fibers (4) (4) . . . being knitted and bound in the lining cloth **(3*a*) of the base cloth or substrate (3). The base cloth (3) is a pile base cloth comprising flocked fibers (5) (5) . . . having a length of about 10 to 30 mm. This base cloth (3) is cut into the form of an animal, and long fibers having a length and a color adapted to the hair bristling state of the animal, which is to be used as the above-mentioned fibers (4) (4) . . . , are suitably selected and are bound with the cut base cloth (3) by hand knitting. In this step, the above-mentioned long fibers (4) (4) . . . are knitted in the base cloth (3) in such a manner as to provide a ratio of about 4:6 for their two lengths on the surface of the base cloth (3). By differentiating these lengths in this way, a hair bristling state analogous to the natural one of the animal can be attained. Since the long fibers (4) (4) . . . are bundled up into units each consisting of 10 to 15 fibers and are attached, as by knitting, in a folded form in the base cloth (3), they can attain a hair bristling state of the base cloth (3) sufficiently analogous to the natural one of the animal with the aid of the high piles even though the knitting interval is about 5 to 10 mm. Further, where the arbitrary portions of the animal toy are to be curled, the above-mentioned knitted fibers (4) (4)** . . . are wound around an aluminum pipe (diameter: about 35 to 45 mm) and heat-treated to attain curling, whereby the animal toy can be endowed with an additional feature as a pet.

Figure 5A:
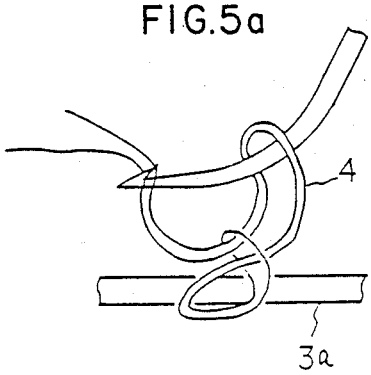
FIGS. 5 (A) and (B), and 6 (A) and (B) are diagrams each illustrating an instance of hand knitting.
Figure 5B:
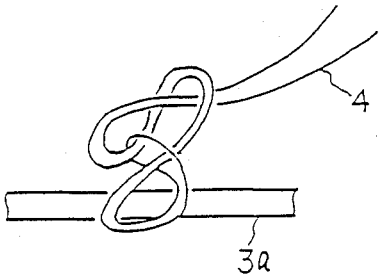
Figure 6A:
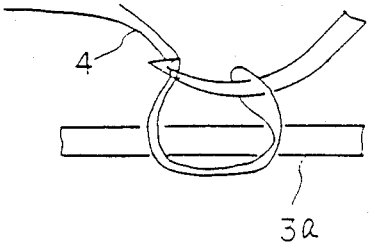
Figure 6B:
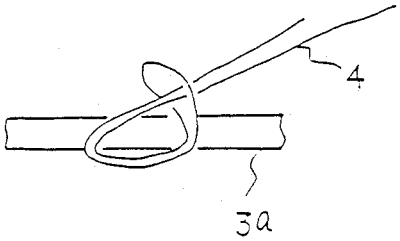

FIGS. 5 (A) and (B), and 6 (A) and (B) each show an instance of the mode of hand knitting, which, however, should not be construed as limitative. A mode of hand knitting suitable for each portion in accordance with the hair bristling state of the animal may be adopted. Illustration will be given to the manner of binding with the lengths of the fibers (4) (4) . . . differing from portion to portion in FIG. 2. The fibers having a length of one folded part of 4 cm and a length of the other folded part of 6 cm are knitted in the portions (a) (a) (a) partitioned off by the dot-and-bar lines, while those having a length of one folded part of 8 cm and a length of the other folded part of 12 cm are knitted in the portion (b), and those having a length of one folded part of 6 cm and a length of the other folded part of 9 cm are knitted in the portions (c). In this way, the resulting product may be really analogous to, for example, a maltese.

As described above, although the fibers (4) (4) . . . are knitted in the base cloth (3) by hand, knitting is relatively easy without necessitating so long a time since the knitting interval is long. Further, despite the long knitting interval, a bristling state can be attained in cooperation with high piles of the base cloth since the fibers (4) (4) . . . are used in a bundled form of units each consisting of 10 to 15 fibers in a folded state. Moreover, since the color tone and/or the fiber length is naturally adapted to the real animal in knitting, association of the natural hair bristling state and color of the animal is achieved with a good hand due to softness.

As described in detail with reference to the above-mentioned embodiment, according to the present invention, flocking of long fibers in a base cloth provides no hardened portions and hence a very good hand, since it involves neither the procedure of bonding a synthetic resin on the back of the base cloth, nor the procedure of coating the same material as that of the long fibers and the root portions of the flocked long fibers to the synthetic resin sheet bonded to the back of the base cloth with an adhesive or heat-welding the root portions of the above-mentioned long fibers to the above-mentioned coating. Further, since hand knitting is adopted, there is no fear of unexpected dehairing. Furthermore, superlong or long fibers with arbitrarily chosen color tone can be used in accordance with an animal, while curling can be effected for improving the feature of the resulting toy as a pet. Moreover, since the interval of knitting in the back lining of the base cloth is relatively long, superlong fibers can also be knitted therein. Thus, an animal toy quite analogous to the real animal can be obtained.

I claim:

1. A process for producing a cloth having a simulated furry touch for making stuffed animal toys comprising: taking a base cloth having a high pile of predetermined length, forming a plurality of individual long fibers into a bundle, whereby said fibers are generally of uniform length, forming a plurality of such bundles, reversely folding each of said bundles of fibers to form a reverse fold of unequal lengths having a ratio of approximately 4 to 6, and securing each of said reversely folded bundles of fibers to said base cloth by knitting said bundles of fibers to said base cloth whereby said bundles of fibers extend above the pile of the base cloth and are knitted at such intervals as to form a pile surface having a soft touch simulating the feel of natural fur.

2. A process for producing a cloth having a simulated furry touch as defined in claim 1, wherein each of said bundles are formed of between 10 to 15 long fibers that are reversely folded to define unequal lengths having a ratio of approximately 4 to 6, and whereby each of said reversely folded bundles are knitted to said base cloth at spaced apart intervals of 5 to 10 millimeters.

* * * * *